US012241711B2

(12) United States Patent
Vitulli et al.

(10) Patent No.: US 12,241,711 B2
(45) Date of Patent: Mar. 4, 2025

(54) GUN MAGAZINE WITH REDUCED COLLAPSED SPRING HEIGHT

(71) Applicants: Brandon Vitulli, Thomasville, GA (US); Steven Hubbard, Mattawan, MI (US)

(72) Inventors: Brandon Vitulli, Thomasville, GA (US); Steven Hubbard, Mattawan, MI (US)

( * ) Notice: Subject to any disclaimer, the term of this patent is extended or adjusted under 35 U.S.C. 154(b) by 0 days.

(21) Appl. No.: 18/118,952

(22) Filed: Mar. 8, 2023

(65) Prior Publication Data

US 2024/0302119 A1 Sep. 12, 2024

(51) Int. Cl.
*F41A 9/70* (2006.01)

(52) U.S. Cl.
CPC ..... *F41A 9/70* (2013.01)

(58) Field of Classification Search
CPC ..... F41A 9/65; F41A 9/70
USPC ..... 42/50, 49.01
See application file for complete search history.

(56) References Cited

U.S. PATENT DOCUMENTS 4,397,453 A * 8/1983 Seecamp ..... F41A 9/70 267/180
5,386,657 A * 2/1995 Racheli ..... F41A 9/69 42/50
5,438,783 A * 8/1995 Sniezak ..... F41A 9/65 42/50
7,797,871 B2 * 9/2010 Bubits ..... F41A 9/71 42/49.01
8,991,084 B2 * 3/2015 Williams ..... F41A 9/62 42/50
9,448,022 B2 * 9/2016 Shreve ..... F41A 11/00
11,009,304 B2 * 5/2021 Cross ..... F41A 9/68
2023/0266084 A1 * 8/2023 Oaks ..... F41A 9/65 42/50

FOREIGN PATENT DOCUMENTS

CN 101881576 A * 11/2010 ..... F41A 9/70

* cited by examiner

*Primary Examiner* — Reginald S Tillman, Jr.
(74) *Attorney, Agent, or Firm* — J. Wiley Horton

(57) ABSTRACT

A novel spring and follower design for a firearm magazine that produce a reduced height when the magazine is fully loaded. The preferred embodiments of the magazine spring include a triple-nested bottom three coils, followed by an alternating succession of double-nested pairs of coils. The bottom three coils and the alternating pairs are configured to remain within a double stack portion of the magazine. The magazine spring also includes a transition portion—comprising elongated coils—configured to extend into the upper portion of the magazine when the magazine is nearly empty. The follower is preferably configured to receive the transition portion of the magazine spring into a lower receiver when the magazine spring is fully compressed.

18 Claims, 13 Drawing Sheets

GUN MAGAZINE WITH REDUCED COLLAPSED SPRING HEIGHT

CROSS-REFERENCES TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to the field of firearms. More specifically, the invention comprises a magazine having a reduced collapsed spring height and consequently an increased internal capacity.

2. Description of the Related Art

It is important to maximize space efficiency in detachable firearm magazines. This is particularly true for pistol magazines—where the magazine must fit inside the pistol's grip and therefore be encircled by the user's hand. Firearms manufacturers provide a fixed volume for the external dimensions of the magazine. The magazine must conform to this fixed volume in order to fit into the firearm. Thus, the external dimensions of a magazine intended for use in a particular firearm are essentially fixed.

The magazine's internal dimensions may vary somewhat, but these are constrained by the cartridge the magazine is designed to house. The magazine tube wall thickness and the cartridge diameter will largely fix the internal magazine width (width being perpendicular to the pistol bore) and internal length (length being parallel to the pistol bore). The internal height is also largely constrained since the top of the magazine tube (incorporating the cartridge feed lips and rails) must rest in a fixed position and the bottom of the magazine tube must also rest in a fixed position (often proximate the base of the pistol grip but sometimes below it for extended magazines). Thus, a magazine designer is constrained as to the internal dimensions as well.

A magazine is intended to (1) reliably feed the cartridges it houses while (2) containing a desired number of cartridges when fully loaded. As those skilled in the art will know, the cartridges within the magazine are forced upward by a magazine spring acting on a follower. The magazine spring is compressed between the base of the magazine tube and the follower. The follower bears against the cartridges and urges them upward toward the cartridge feed lips and rails.

The follower is urged downward—and the magazine spring is compressed—as more cartridges are loaded into the magazine. The number of cartridges that can be loaded is usually limited by the magazine spring reaching a fully compressed state and arresting the further downward motion of the follower. Significant effort has been directed to the design of followers and magazine springs in order to minimize the fully compressed height of the spring/follower assembly (thereby maximizing cartridge capacity). An example of this prior art work is described in U.S. Pat. No. 4,397,453 to Seecamp (1983). In the Seecamp design, successive coils in the magazine spring are nested so that multiple coils can collapse into the height of a single coil. This reduces the fully compressed height of the magazine spring.

An objective of the present invention is the provision of additional cartridge capacity in a magazine having standard external dimensions.

BRIEF SUMMARY OF THE PRESENT INVENTION

The present invention integrates a novel spring design with a novel interface between the top of the magazine spring and the follower to produce a reduced height when the magazine is fully loaded. The preferred embodiments of the magazine spring include a triple-nested bottom three coils, followed by an alternating succession of double-nested pairs of coils. The bottom three coils and the alternating pairs are configured to remain within a double stack portion of the magazine. The magazine spring also includes a transition portion-comprising elongated coils—configured to extend into the upper portion of the magazine when the magazine is nearly empty. The follower is preferably configured to receive the transition portion of the magazine spring into a lower spring receiver when the magazine spring is fully compressed. These features combine to provide a lower position for the follower when the magazine spring is fully compressed.

REFERENCE NUMERALS IN THE DRAWINGS

Figure 1:
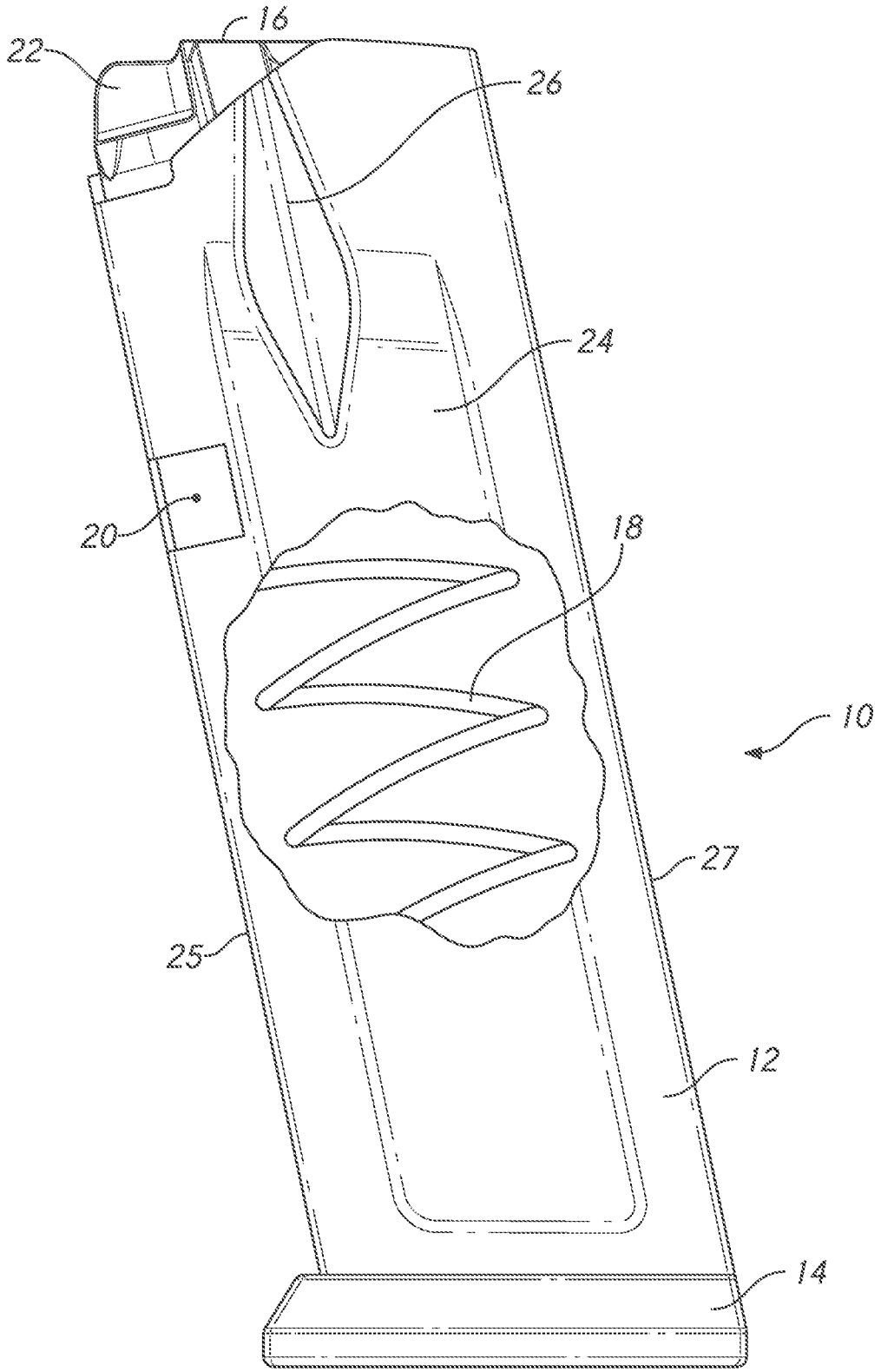
FIG. 1 is a side elevation view with a cutaway, showing an embodiment of the present invention.

10 magazine assembly
12 tube
14 base
16 follower
18 spring
20 magazine latch relief
22 slide latch relief
24 planar indentation
25 forward wall
26 angled indentation
27 rearward wall
28 double stack portion
30 transition portion
32 feed relief
34 feed rail/lip
36 plate
38 protrusion
40 opening
42 cavity
44 lateral flange
46 lateral slot
50 rearward portion
52 forward portion
54 first semi-circle
56 first straight portion
58 second semi-circle
60 second straight portion
62 straight portion axis
64 straight portion axis
66 parallel axis
68 parallel axis
70 straight portion
72 straight portion
74 left notch
76 right notch
78 forward skirt
80 rearward skirt
82 curved cradle
84 ridge
86 chamfer
88 spring receiver cavity
90 forward boss
92 rearward boss
94 cartridge
96 forward guide surface
98 rearward guide surface
100 rear corner relief
102 central lateral relief
104 forward corner relief
106 right front leg
108 left front leg
110 right rear leg
112 left rear leg

DETAILED DESCRIPTION OF THE INVENTION

The following descriptions pertain to preferred embodiments of the present invention. Having reviewed these descriptions, many more embodiments will occur to those skilled in the art. Accordingly, the scope of the invention should be set by the claims presented at the end of this disclosure rather than the embodiments described.

The invention is well-suited to "double stack" magazines, in which at least a portion of the magazine houses two overlapping columns of cartridges. FIG. 1 provides a side elevation view of such a magazine assembly 10. This disclosure uses a directional convention (upper, lower, forward, rearward, etc.) that is based on the firearm. The assumption is that the firearm's barrel is held in a horizontal position with a magazine well configured to receive the inventive magazine facing downward (so that the magazine is loaded into the well by moving it generally upward). "Forward" is toward the muzzle and "rearward" is the opposite. "Left" is the left side of the firearm and "right" is the opposite. "Width" refers to a measurement taken in a direction that is horizontal and perpendicular to the barrel. "Length" refers to a measurement taken in a direction that is parallel to the barrel. The orientation shown in FIG. 1 is the orientation in which a magazine will typically be used. The firearm into which the magazine is inserted—in this case a pistol—is normally held and fired upright with the magazine well being contained within a grip the user holds.

Tube 12 provides the main structure of the magazine assembly. The term "tube" is conventional in the industry, even though the structure is not round. The tube is typically a thin-walled hollow structure, open at the top and bottom. Rearward wall 27 is generally perpendicular to the tube's side walls. Forward wall 25 is more rounded.

Base 14 can be any structure that is attached to the lower portion of the tube 12. It is preferable for the base to provide gripping features that facilitate the quick removal of the magazine. In the example of FIG. 1, base 14 includes an expanding section that is easily grasped.

Follower 16 slides up and down within the hollow interior of tube 12. The upper portion of the tube tapers inward. The very top portion of the tube preferably includes a pair of feed lips/rails (Some magazines incorporate a pair of rearward feed lips and a pair of forward feed rails. Pistol magazines, such as the one shown, often combine these features). The feed lips/rails properly locate a cartridge being fed by the magazine so that a moving slide will "strip" a fresh cartridge off the top of the magazine each time the firearm cycles. Follower 16 is sized so that it cannot escape through the feed lips/rails and out the top of the tube. The follower is thus captured within the tube. When the last cartridge is moved out of the magazine, follower 16 will be arrested in its fully raised position-which is shown in FIG. 1.

FIG. 1 includes a cutaway through the side wall facing the viewer. Spring 18 rests within the tube's interior—compressed between base 14 and follower 16. The spring remains in a compressed state in all the normal operations of the magazine. The base is retained in a fixed position, so the degree of compression of the spring is determined by the vertical position of the follower within the tube. The spring urges the follower upward. The follower, in turn, urges the cartridges contained within the magazine upward.

The exemplary magazine assembly 10 has many other conventional features needed for the operation of a firearm. For example, magazine latch relief 20 receives a firearm magazine latch that holds the magazine in the firearm until a user releases the latch. Inward planar indentations 24 are provided in each of the side walls. These serve to guide the sides of the cartridges contained within the magazine and provide an additional volume rearward of the planar indentations for the rims of the cartridges. Angled indentations 26 (one on each side) assist the cartridges in traveling upward from the double-stack portion of the magazine and through a transition portion where the cartridges transition toward a single-stack configuration (though not necessarily a fully developed single-stack configuration).

Slide latch relief 22 is formed in the forward portion of follower 16. As those skilled in the art will know, a slide latch relief is needed so that—after the last round is fed from the magazine—a tab on the firearm's slide latch will move into relief 22 and cause the slide latch to hold the firearm's slide in the open position. Many other conventional features may be included in the inventive magazine. These include various types of feed lips, feed rails, and partial feed ramps. The inventive magazine may also include one or more openings that allow a user to see the number of cartridges contained in the magazine.

Figure 2:
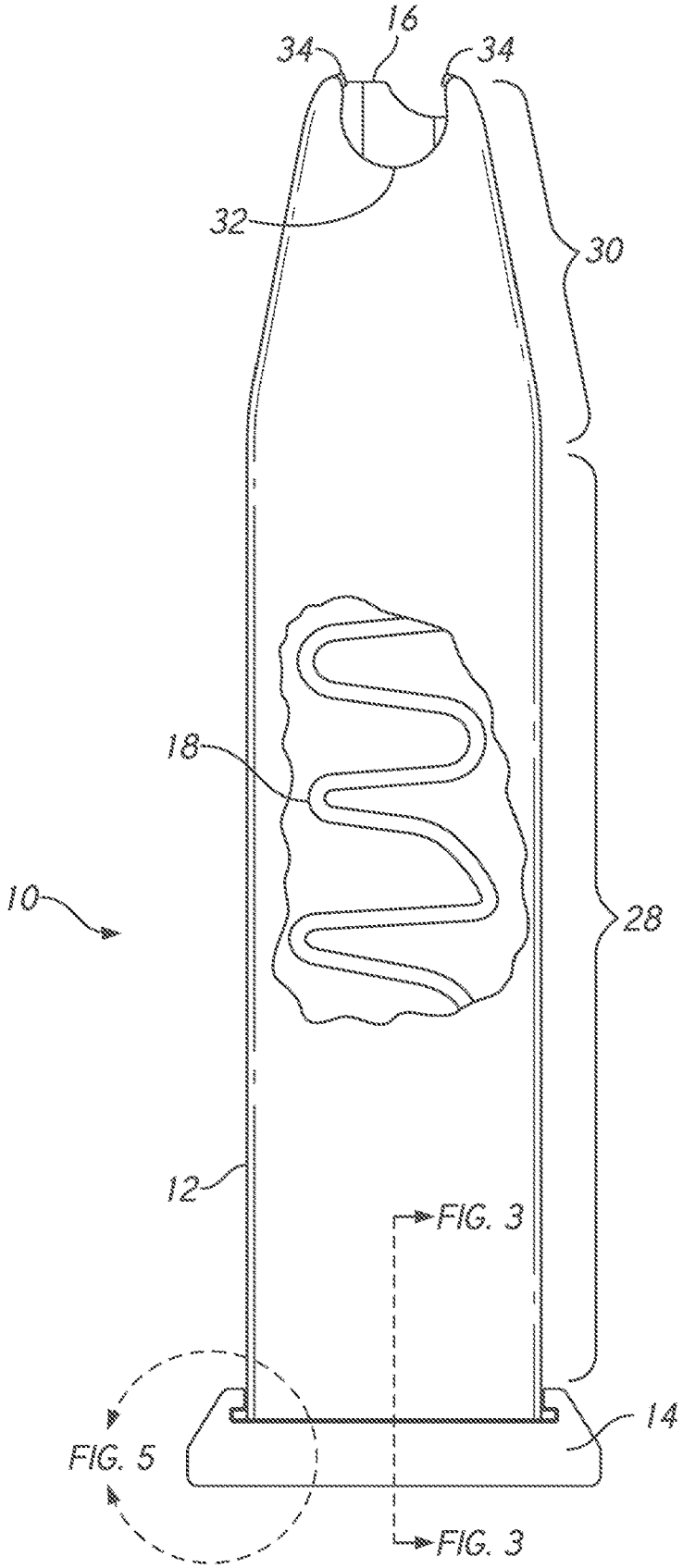
FIG. 2 is a rear elevation view with a cutaway, showing the embodiment of FIG. 1.

FIG. 2 shows the same exemplary embodiment in a rear elevation view. The reader will note how the two side walls angle inward when traveling from double stack portion 28 of the magazine to transition portion 30 and ultimately to the vicinity of feed rails/lips 34. The reader will note how the narrowing and partial closure of the top of the magazine tube "captures" follower 16 at the uppermost point in its travel. A cutaway in the rearward wall allows the reader to again see a portion of spring 18.

A magazine assembly is generally created by inserting the follower and spring through the open lower end of the tube. The spring is then compressed and the lower end of the tube is closed by the addition of a base. In this context the term "base" should be broadly understood to mean a component or assembly of components that restrains the lower end of the magazine spring. There are endless ways to attach a base to the magazine tube. FIGS. 2-5 illustrate one good approach.

Figure 5:
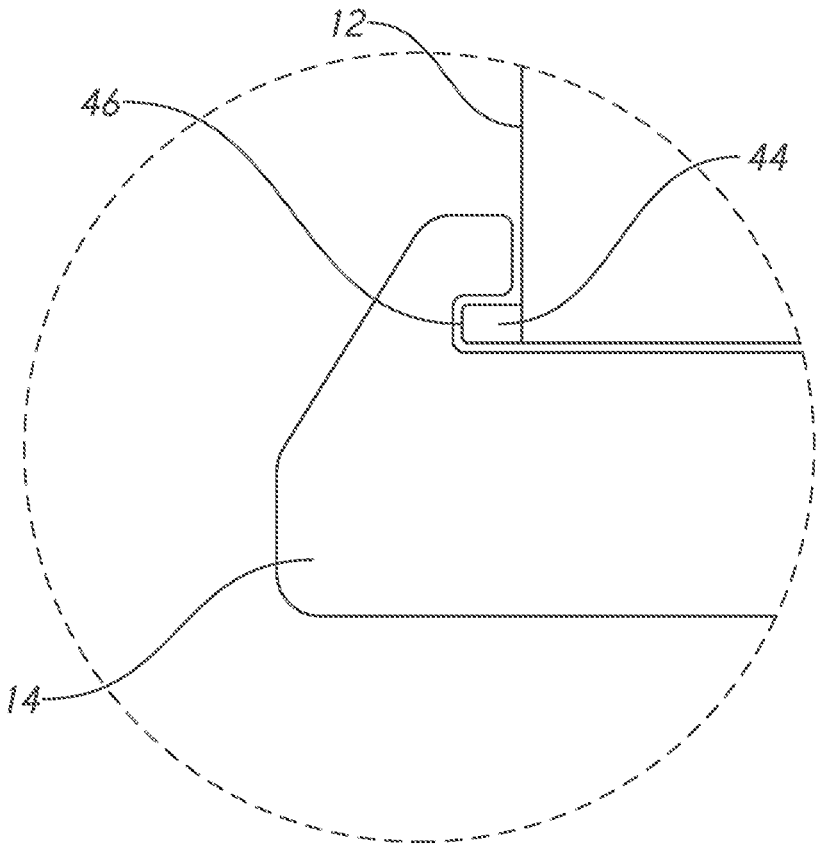
FIG. 5 is a detailed rear elevation view, showing how the base attaches to the tube in the embodiment of FIG. 1.

In FIG. 2, the reader will note a "callout" for FIG. 5. FIG. 5 provides a detailed view of a portion of FIG. 2. In FIG. 5, the reader will note how lateral flange 44 projects outward (to the left) at the bottom of tube 12. A second lateral flange projects from the right side of the tube. Base 14 includes two lateral slots 46 designed to slidably engage the two lateral flanges 44. The base attaches to the tube by sliding the two lateral slots 46 over the two lateral flanges 44.

Figure 3:
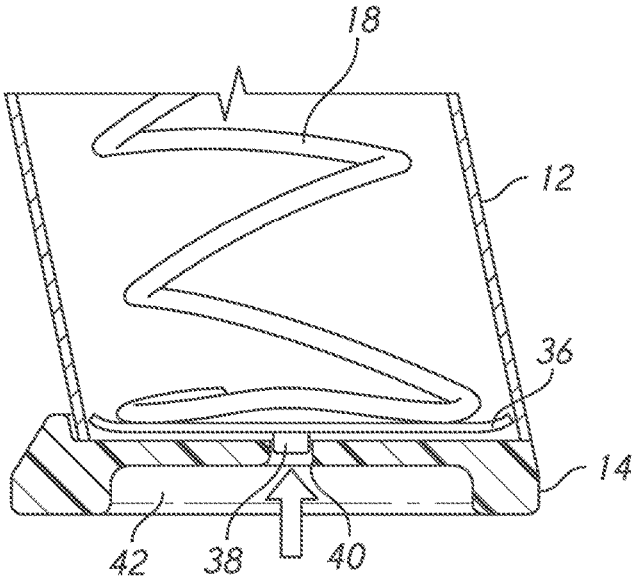
FIG. 3 is a sectional side elevation view, showing one embodiment of the magazine base.
Figure 4:
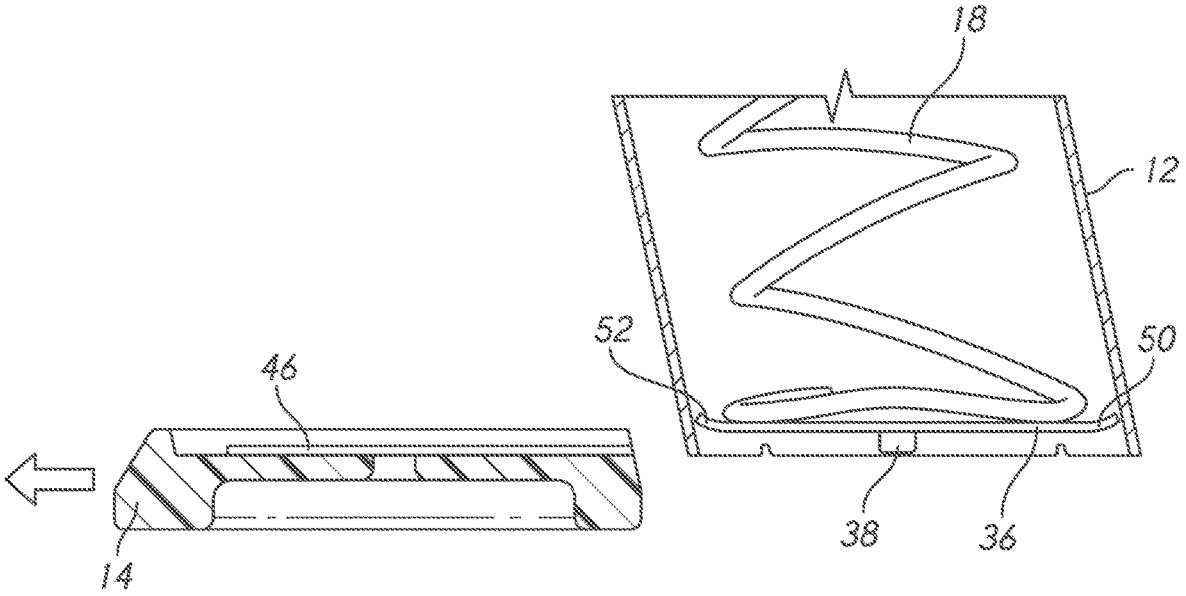
FIG. 4 is sectional side elevation view, showing the removal of the magazine base for the embodiment of FIG. 1.

FIGS. 3 and 4 illustrate the selective removal of the base from the tube. FIG. 3 shows a sectional view through the middle of the assembly (note callout in FIG. 2). Base 14 is secured to tube 12 via engagement of the lateral flanges on the tube with the lateral slots in the base. This arrangement allows the base to slide free of the tube when moved in the forward direction. However, the base is normally restrained by a second engagement. Plate 36 in this example is a thin metal plate that fits within the open bottom of the tube. Protrusion 38 extends downward form plate 36. Base 14 includes an opening 40 positioned to receive protrusion 38 as shown. Cavity 42 is preferably provided in the lower portion of base 14 to provide access to opening 40.

In order to remove the base from the tube, the user employs a pointed object to press upward on protrusion 38. This motion compresses spring 18 and raises protrusion 38 clear of opening 40. The user can then slide base 14 forward (to the left in the view of FIG. 3) to remove the base from the tube. FIG. 4 shows base 14 after it has been moved free of tube 12. The reader will note that lateral slots 46 in the base are clear of the lateral flanges on the tube. At this point plate 36 is free to slide out the bottom of the tube, along with the magazine spring and follower.

Still looking at FIG. 4, the reader will note how plate 36 in this embodiment has an upward tilting rearward portion 50 and an upward tilting forward portion 52. These tend to center the first coil of the magazine spring on plate 36. Many other variations are possible for the base. In some of these embodiments a depression can be integrally molded into the upward-facing surface of the base and this helps to locate the lower portion of the magazine spring. The invention is not limited to any particular type of base or combination of base and plate.

Figure 6:
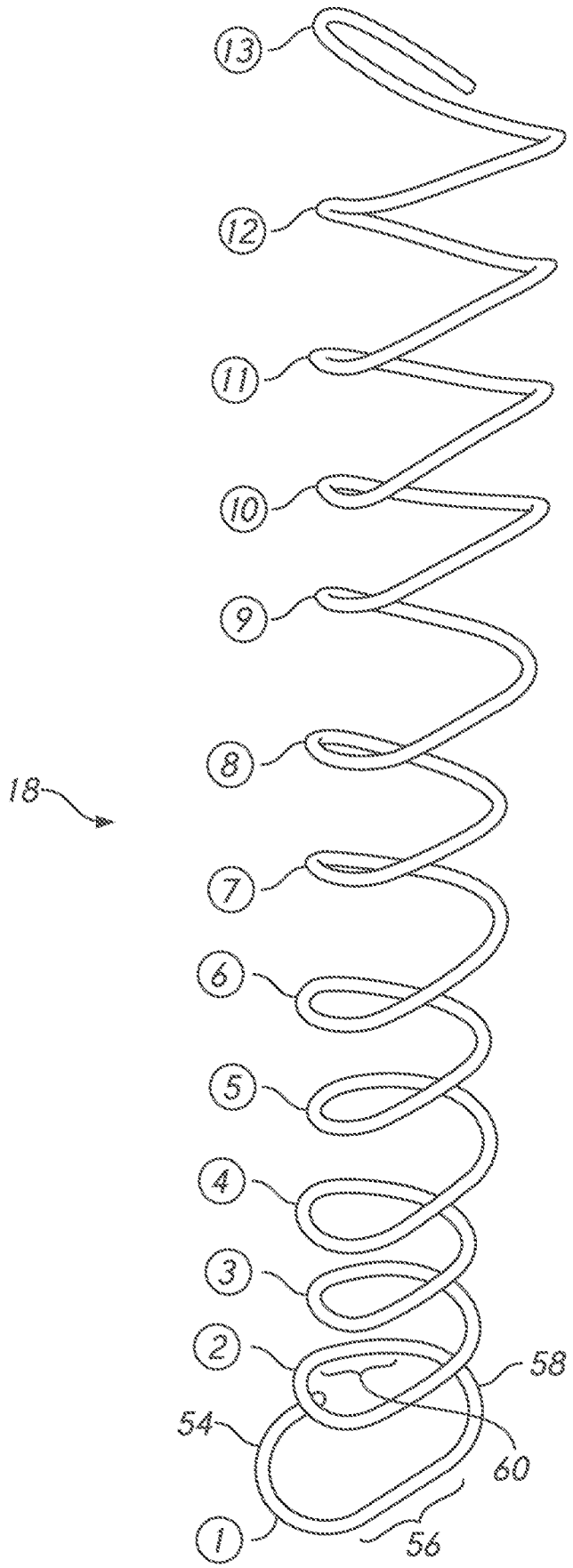
FIG. 6 is a perspective view, showing a magazine spring made according to the present invention.
Figure 7:
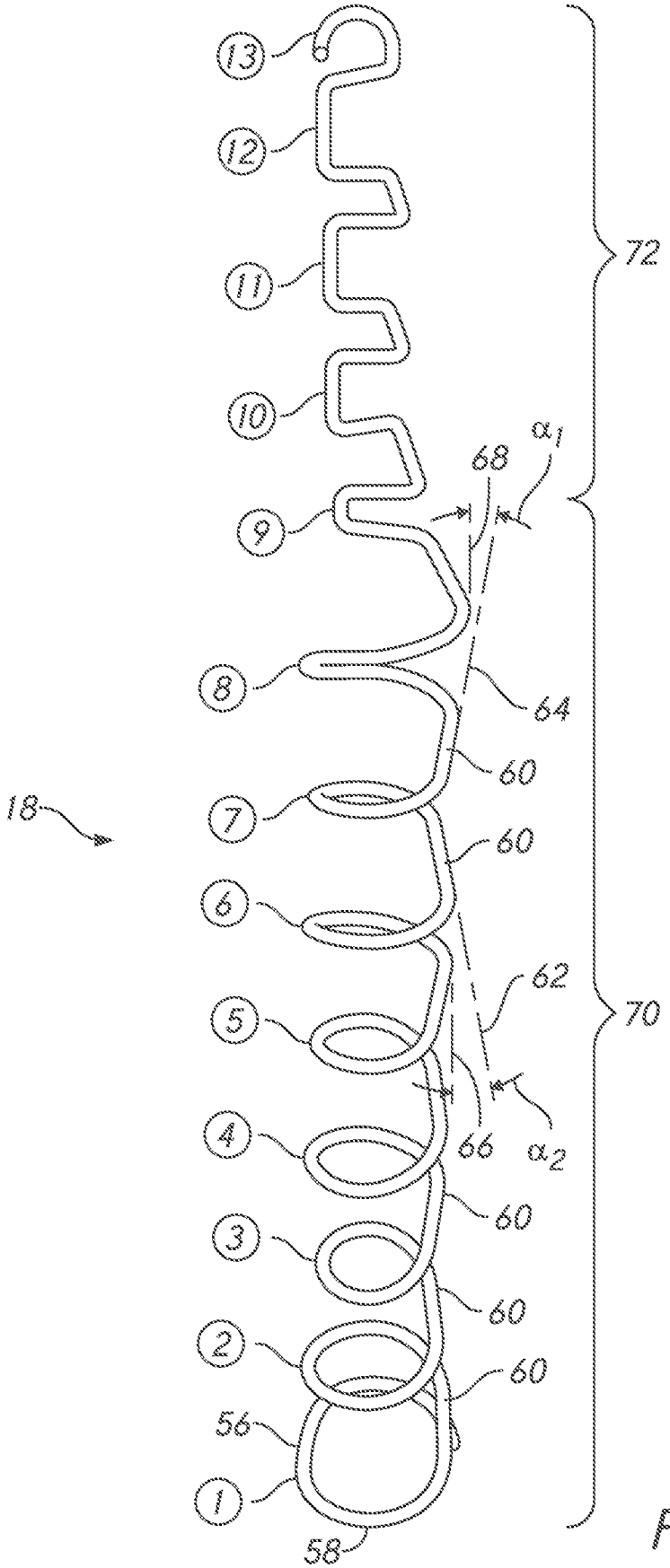
FIG. 7 is a rear perspective view, showing the magazine spring of FIG. 6.

FIGS. 6 and 7 provide two perspective views of the spring in an uncompressed state. As those skilled in the art will know, the magazine is always in a compressed state when installed in the tube. However, it is helpful to illustrate the structure of the spring in an uncompressed state so that the individual coils are easier to see. FIG. 6 is a perspective view from a vantage point off to the left, forward side of the spring. FIG. 7 is a perspective view from a vantage point that is to the rear of the spring.

The invention is not limited to a spring having any particular number of coils, but the example shown has 13 coils (with the first coil having an additional component and the thirteenth coil not being a complete coil). Each coil is given a number enclosed in a circle. A number enclosed in a circle therefore denotes a coil as a whole and not a particular portion of a coil.

Each coil has a first semi-circle of wire (the forward portion of the coil), a first straight portion, a second semi-circle (the rearward portion of the coil) and a second straight portion. Coil 1 has first semi-circle 54, first straight portion 56, second semi-circle 58, and second straight portion 60 (The reader will also note a "0th" straight portion that exists just prior to first semi-circle 54). Each successive coil going from bottom to top repeats this pattern. The circled label for each coil rests in the middle of the first semi-circle for that particular coil.

While the same nomenclature is used for the coils from bottom to top, the reader will note that the structure of the spring is by no means uniform. It is preferable to use a constant diameter spring wire for the entire spring, but the nature of the bends formed in the wire change and the shape of the coils differ. The differences allow some of the adjacent coils to nest together.

FIG. 7 serves well to illustrate the differences in the coils. Adjacent coils nest within straight portion 70. However, the nesting scheme is not uniform in this embodiment. The first three coils (Coils 1, 2 and 3) are configured to nest together to a fully compressed height of one spring diameter. The next two coils (Coils 4 and 5) are configured to nest together to a fully compressed height of one spring diameter. The next two coils (6 and 7) are configured to nest together to a fully compressed height of one spring diameter. Coils 8-13 stack without nesting. This adds an additional 5 wire diameters to the fully compressed height of the spring. Without nesting the overall fully compressed height of the spring would be 13 wire diameters. With the nesting configuration illustrated, the fully compressed height is approximately 9 wire diameters.

As those skilled in the art will know, the number of cartridges that can be loaded into a given magazine assembly is limited by the position of the follower when the spring is in a fully compressed state. An objective is to provide a lower position for the follower so that one or more additional cartridges can be loaded. Even a small difference in the follower's fully compressed position can be significant.

The spring wire in the example of FIGS. 6 and 7 has a diameter of 0.050 inches (1.27 mm). Reducing the compressed spring height by 4 wire diameters produces a total height reduction of 0.200 inches (5.08 mm). The significance of this reduction may be seen by considering the base diameter of a common cartridge—the 9 mm parabellum. This cartridge has a base diameter of 0.392 inches (9.96 mm). In a single-stack magazine a designer must "find" an additional 0.392 inches of internal height to add another cartridge to the magazine's fully loaded state. However, in a double-stacked configuration, each additional cartridge only requires an additional height of ½ the base diameter (0.196 for a 9 mm parabellum cartridge). Thus, the improvement to the spring overall compressed height admits at least one additional cartridge. Improvements to the spring/follower interface provide an additional height savings which allow for at least one more additional cartridge—as will be described subsequently.

Before leaving FIG. 7, another point to be noted is the alternating crossover pattern of the second straight portions 60 in Coils 3 through 8. A conventional spring collapses into a helical "stack" with the helix angle being present. The alternating crossover pattern for the second straight portions 60 of the inventive spring allows the spring to collapse into a more fully flattened state. In addition, the collapsing pattern created does not induce significant rotation of the ends of the spring.

The alternating crossover pattern can be seen in comparison to parallel axes 64, 66. These two parallel axes are parallel to the side walls of the magazine tube. Straight portion axis 62 extends from the center of second straight portion 60 of Coil 6. The reader will note how second straight portion 60 of Coil 6 angles inward by an angle $\propto_2$. Straight portion axis 64 extends from the center of second straight portion 60 of Coil 7. This second straight portion angles outward by an angle $\propto_1$. The use of these angled portions allows the second straight portion of Coil 7 to pass over the top of the second straight portion of Coil 6. Similar crossovers are formed at other points—as can be seen in the view.

Figure 8:
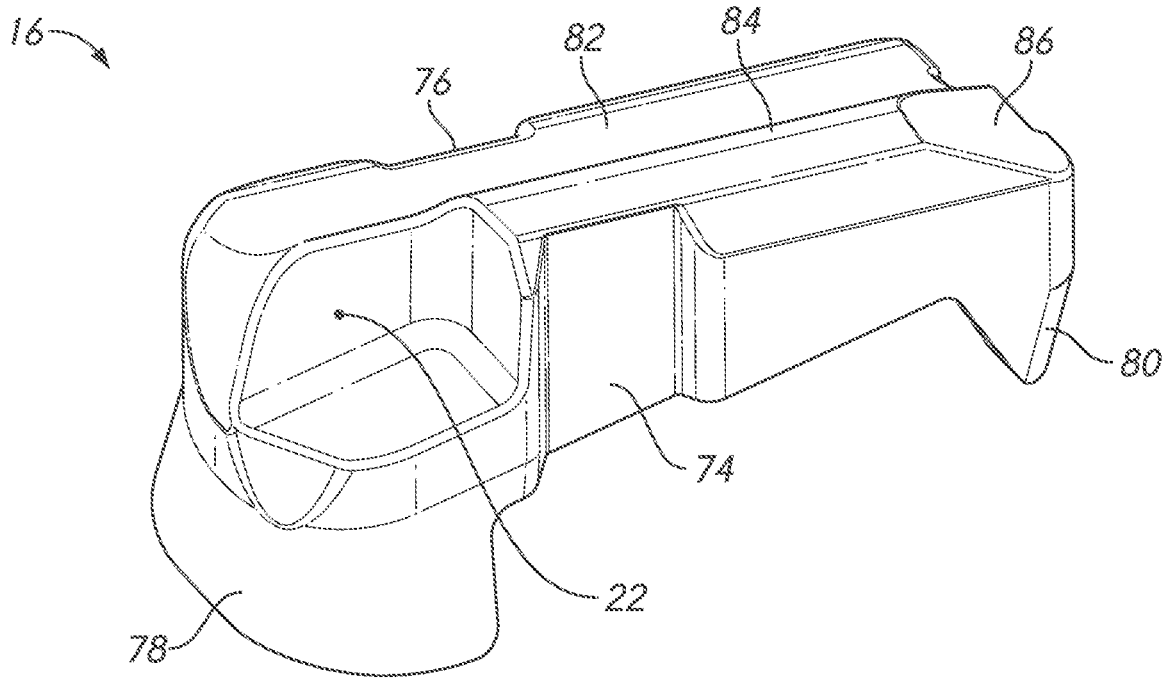
FIG. 8 is a perspective view, showing an embodiment of the magazine follower.

As stated previously, the design of the follower and the interaction between the follower and the spring provide another height savings when the spring is in a fully compressed state. FIG. 8 provides a perspective view of a follower 16. Forward skirt 78 descends from the forward portion of the follower and rearward skirt 80 descends from the rearward portion. The upward-facing surface includes curved cradle 82. Ridge 84 blends curved cradle 82 into the upper portion of the follower. The curved cradle is shaped to engage the cylindrical exterior surface of the lowermost cartridge in a stack of cartridges. The shape of the cradle urges that cartridge to the right and upwards.

Chamfer 86 is provided on the upper rear portion of the follower. The chamfer is provided to ease the passing of a cartridge base over the top of the follower as the last round is fed into the firearm. The chamfer also allows the advancing breech face (on the slide) to pass over the top of the follower in the event the user releases the slide latch and returns the slide to its forward position after the last round is fired.

Left notch 74 and right notch 76 are provided on the lateral sides of the follower. Left notch 74 engages angled indentation 26 on the left side of the magazine. This interaction helps to center the follower as it travels upward toward the top of the tube. Right notch 76 engages the angled indentation on the right side of the magazine.

Figure 9:
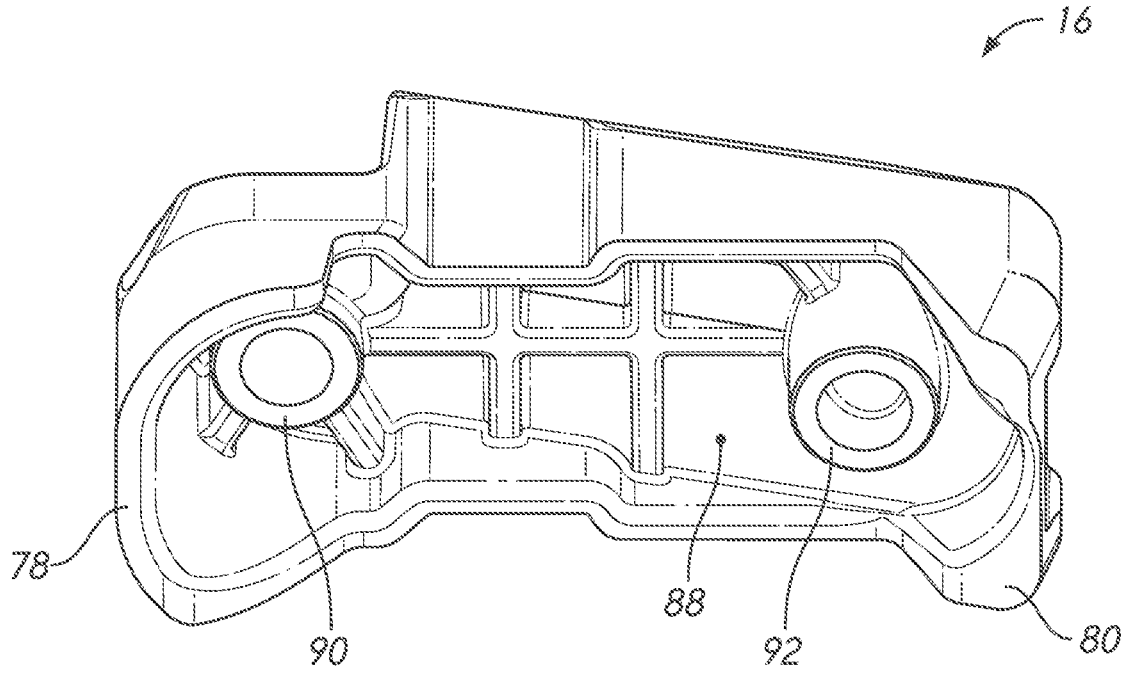
FIG. 9 is a perspective view, showing the follower of FIG. 8 from another vantage point.

FIG. 9 shows the downward-facing portion of the follower. The lower portion opens into a hollow spring receiver cavity 88. The cavity is located between forward skirt 78 and rearward skirt 80 (and extends upward into the interior of the follower). Spring engagement features are preferably included. In this example, forward boss 90 and rearward boss 92 extend downward within the spring receiver cavity in order to engage the top of the spring.

Figure 10:
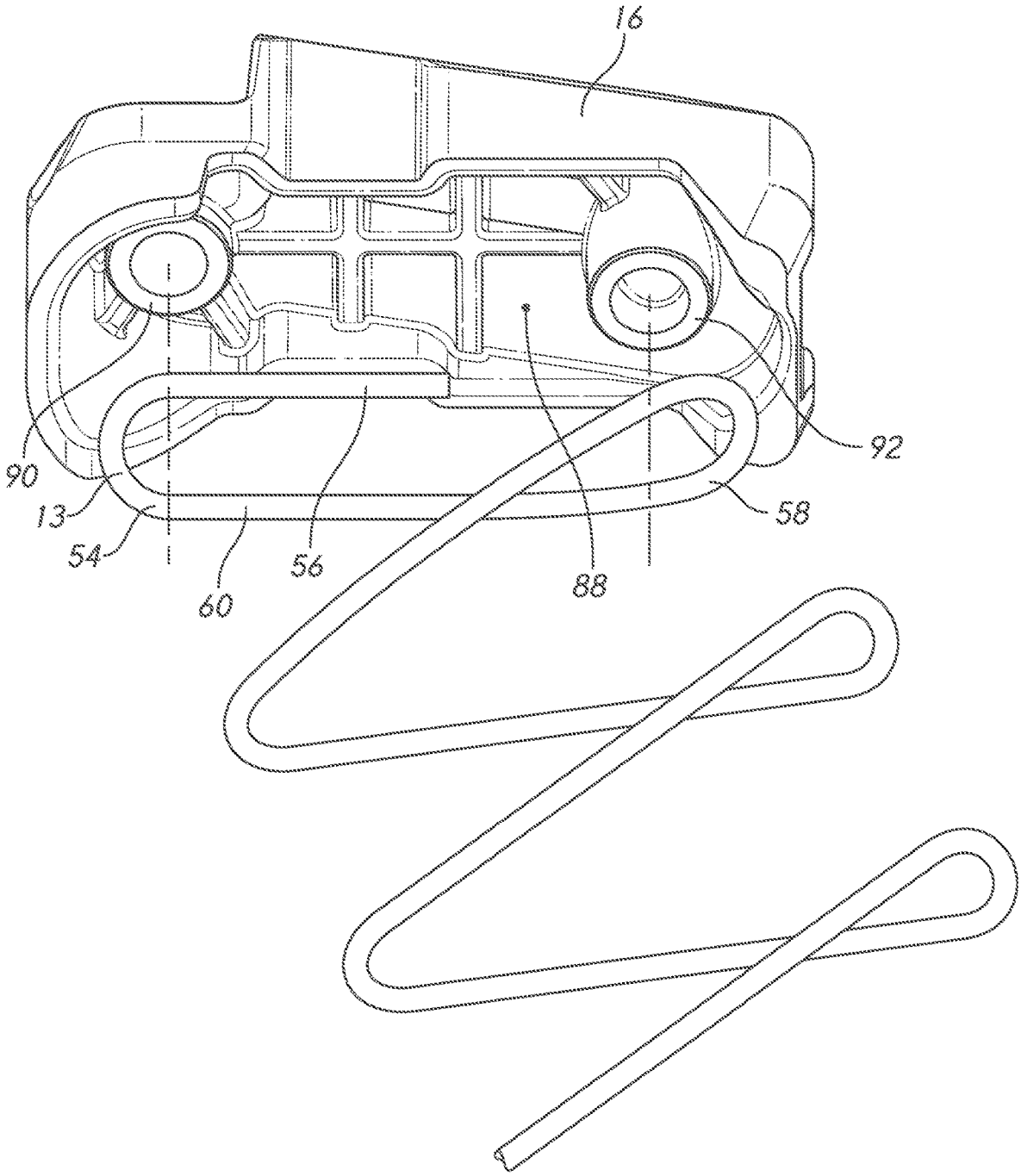
FIG. 10 is a perspective view, showing the interface between the follower and the spring.

FIG. 10 provides an exploded perspective view of follower 16 and the top of the spring. Second semi-circle 58 of Coil 12 fits around rearward boss 92. First semi-circle 54 of Coil 13 fits around forward boss 90. These features positively connect the follower to the spring.

Figure 13:
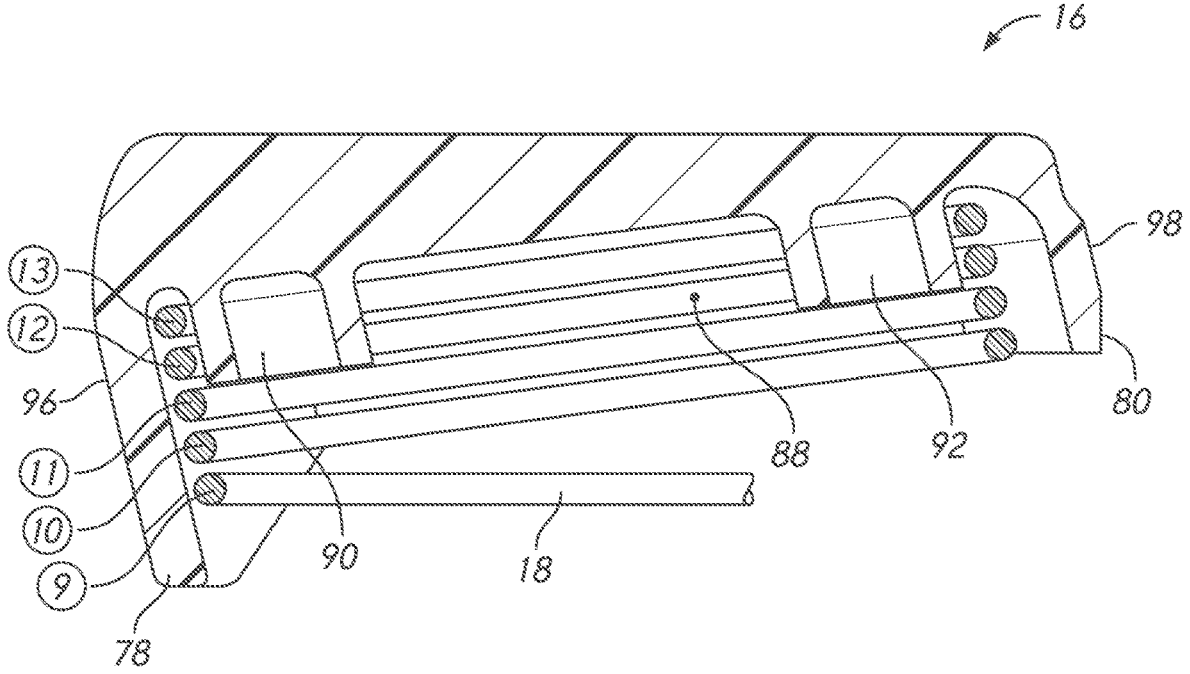
FIG. 13 is a sectional elevation view taken through the assembly of the follower and the magazine spring.

FIG. 13 provides a sectional view through the mid-plane of follower 16 with spring 18 installed. The forward part of the follower includes forward guide surface 96—which is positioned to smoothly slide along the interior of the forward portion of the tube. The rearward part of the follower includes rearward guide surface 98—which is positioned to smoothly slide along the interior of the rearward portion of the tube. These two guide surfaces act to maintain the follower in the desired orientation (parallel to the cartridges and the feed rails) without allowing it to pitch and thereby interrupt the desired travel.

In FIG. 13 the reader will also note how spring receiver cavity 88 is able to encompass the top four coils (Coils 10-13) of the magazine spring when the spring is in a fully compressed state. Note that Coil 9 is shown only partially compressed, but this is just to allow the reader to easily visualize how the top four coils can be contained within the follower.

In other versions the follower may only house two or three coils in the fully compressed state. However, for the case of a 9 mm parabellum cartridge, housing four coils within the follower is desirable since this will lower the position of the follower's upper surface by four wire diameters—or about 0.200 inches. The reader will recall for the 9 mm parabellum cartridge that each additional 0.196 of internal magazine height allows the addition of one more cartridge in the double-stack configuration. Thus, the follower/spring interface shown allows the addition of one more cartridge.

The reader will thus understand that the inventive magazine assembly provides additional internal height (and thereby additional ammunition capacity in the same external form) by (1) optimizing the spring so that its fully compressed height is reduced, and (2) optimizing the follower/spring interface so that some upper spring coils are contained within the follower's spring receiver cavity when the spring is fully compressed-thereby allowing the follower to assume a lower position within the tube.

Figure 11:
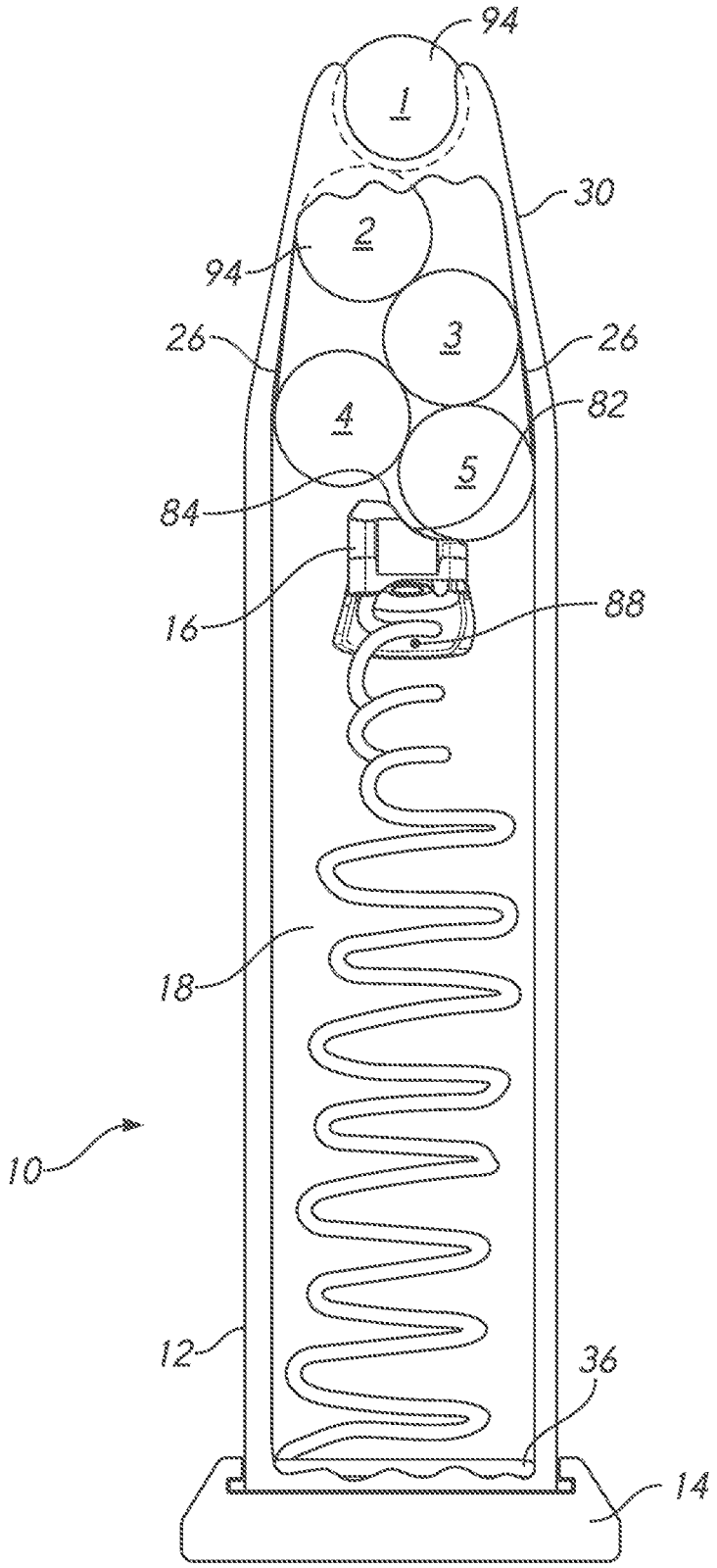
FIG. 11 is a rear elevation view, showing the inventive magazine assembly with five cartridges loaded.
Figure 12:
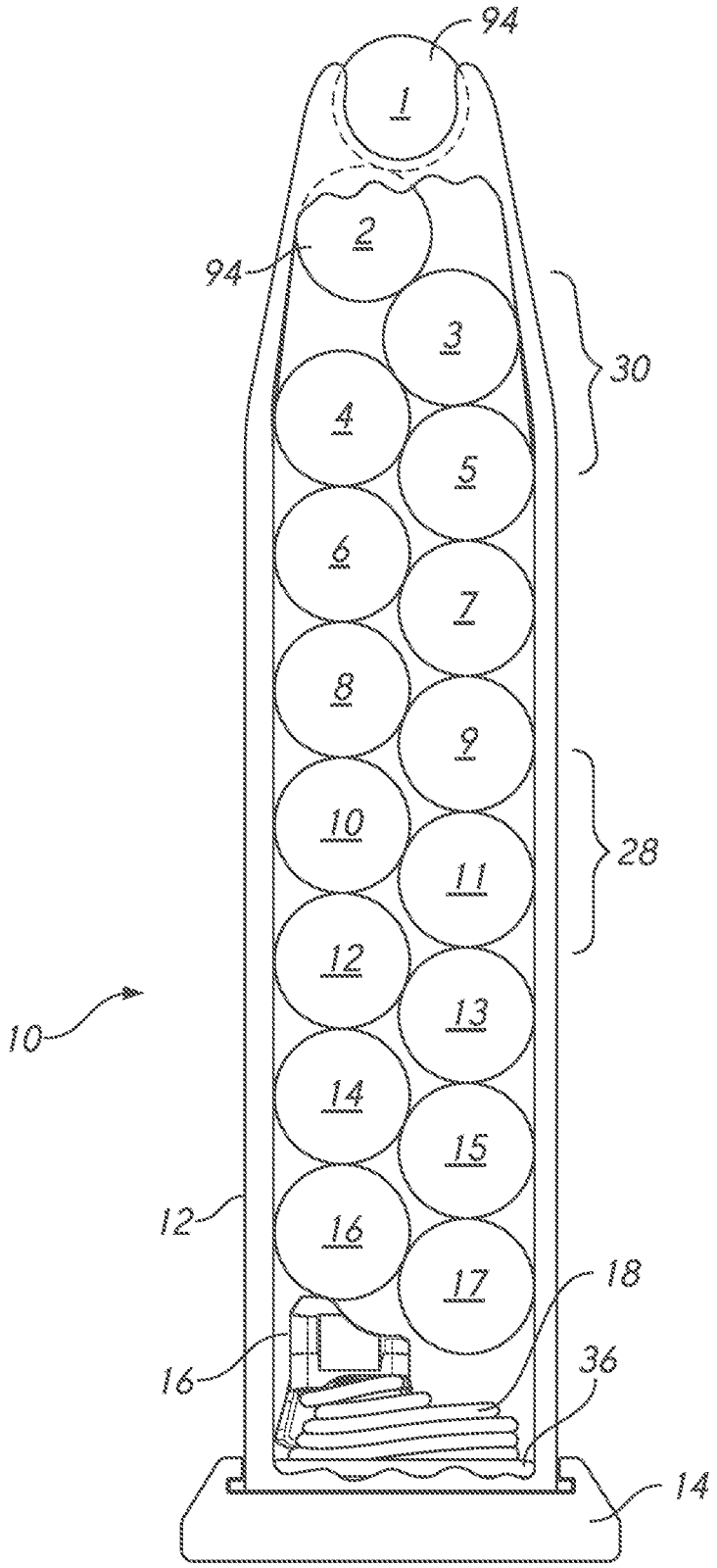
FIG. 12 is a rear elevation view, showing the inventive magazine assembly with seventeen cartridges loaded.

FIGS. 11 and 12 serve to illustrate the significant advantage of the present invention. The outside dimensions of the magazine assembly 12 shown in FIG. 11 ordinarily permit a magazine capacity of 15 cartridges. With the internal height advantages of the present invention, the same magazine is able to house 17 cartridges.

FIG. 11 shows a rear elevation view of magazine assembly 10. A rear cutaway is provided so that the internal features can be seen. At this time 5 cartridges (labeled 1-5) are loaded in the magazine. Follower 16 lies in an intermediate position within the tube. Curved cradle 82 engages the lowermost cartridge and ridge 84 ensures that the lowermost cartridge is urged to the right. The follower is shown centered within the space to show the interaction between the curved cradle 82 and the lowermost cartridge. This relationship is in fact what would exist with the follower advance up toward the top of the tube. In the state shown, follower 16 will likely be positioned more to the left (as spring 18 deflects to the left). It will still urge cartridge 5 upward and against the right wall of the magazine, however.

FIG. 12 shows the same magazine when it is loaded to its maximum capacity. The straight portion 70 and transition portion 72 of the spring have been fully compressed. The straight portion is fully nested-meaning that all the nesting arrangements of the adjacent springs have been achieved. The transition portion for the spring does not nest. However, the reader will note how most of the transition portion (typically four coils) is contained within the spring receiver cavity of follower 16. In this state it is possible to load 17 cartridges in a magazine that would ordinarily only hold 15.

The same inventive enhancements can be added to a magazine having a taller tube. Using this approach a magazine ordinarily holding 17 rounds can be made to hold 19 rounds, while a magazine ordinarily holding 19 rounds can be made to hold 21 rounds.

Exemplary dimensions serve to aid the reader's understanding. Looking again at the specific example of FIG. 7, the maximum width for each coil is presented (in inches/mm) in the following table:

| COIL | WIDTH |
|---|---|
| 1 | 0.814/20.7 |
| 2 | 0.690/17.5 |
| 3 | 0.580/14.7 |
| 4 | 0.690/17.5 |
| 5 | 0.580/14.7 |
| 6 | 0.690/17.5 |
| 7 | 0.580/14.7 |
| 8 | 0.690/17.5 |
| 9 | 0.540/13.7 |
| 10 | 0.342/8.69 |
| 11 | 0.330/8.38 |
| 12 | 0.330/8.38 |
| 13 | 0.330/8.38 |

Looking at FIG. 6, the nesting scheme for straight portion 70 (the first 8 coils) is very complex to describe. A table will be presented to describe the nesting characteristics. A system of simplified nomenclature is needed. As explained previously, each coil has a first semi-circle 54, a first straight portion 56, a second semi-circle 58, and a second straight portion 60. Each of these four portions of a coil will be abbreviated as "1SC," "1SP," "2SC," and "2SP" (respectively). In the system of nomenclature, the coil to which a particular portion belongs will be provided after a "/." Thus, the characters "1SC/1" shall refer to the first semi-circle of Coil 1. As an additional example, "2SP/C2" refers to the second straight portion of Coil 2. The term "inside" means one component nests toward the interior of the coil with respect to another component. The term "outside" means one component nests toward the exterior of the coil with respect to another component. The term "over" means that one component passes above another component (It crosses over the top). With this convention in mind, the nesting scheme of the embodiment of FIG. 7 is described by the following table:

| Coil | 1SC | 1SP | 2SC | 2SP |
|---|---|---|---|---|
| 1 | — | — | — | — |
| 2 | inside 1SC/C1 | inside 1SP/C1 | inside 2SC/C1 | inside 2SP/C1 |
| 3 | inside 1SC/C2 | inside 1SP/C2 | inside 2SC/C2 | over 2SP/C2 |
| 4 | outside 1SC/C3 | outside 1SP/C3 | outside 2SC/C3 | over 2SP/C3 |
| 5 | inside 1SC/C4 | inside 1SP/C4 | inside 2SC/C4 | over 2SP/C4 |
| 6 | outside 1SC/C5 | outside 1SP/C5 | outside 2SC/C5 | over 2SP/C5 |
| 7 | inside 1SC/C6 | inside 1SP/C6 | inside 2SC/C6 | over 2SP/C6 |
| 8 | outside 1SC/C7 | over 1SP/C7 | over 2SC/C7 | over 2SP/C7 |
| 9 | over 1SC/C8 | over 1SP/C8 | over 2SC/C8 | over 2SP/C8 |
| 10 | over 1SC/C9 | over 1SP/C9 | over 2SC/C9 | over 2SP/C9 |
| 11 | over 1SC/C10 | over 1SP/C10 | over 2SC/C10 | over 2SP/C10 |
| 12 | over 1SC/C11 | over 1SP/C11 | over 2SC/C11 | over 2SP/C11 |
| 13 | over 1SC/C12 | over 1SP/C12 | — | — |

Figure 14:
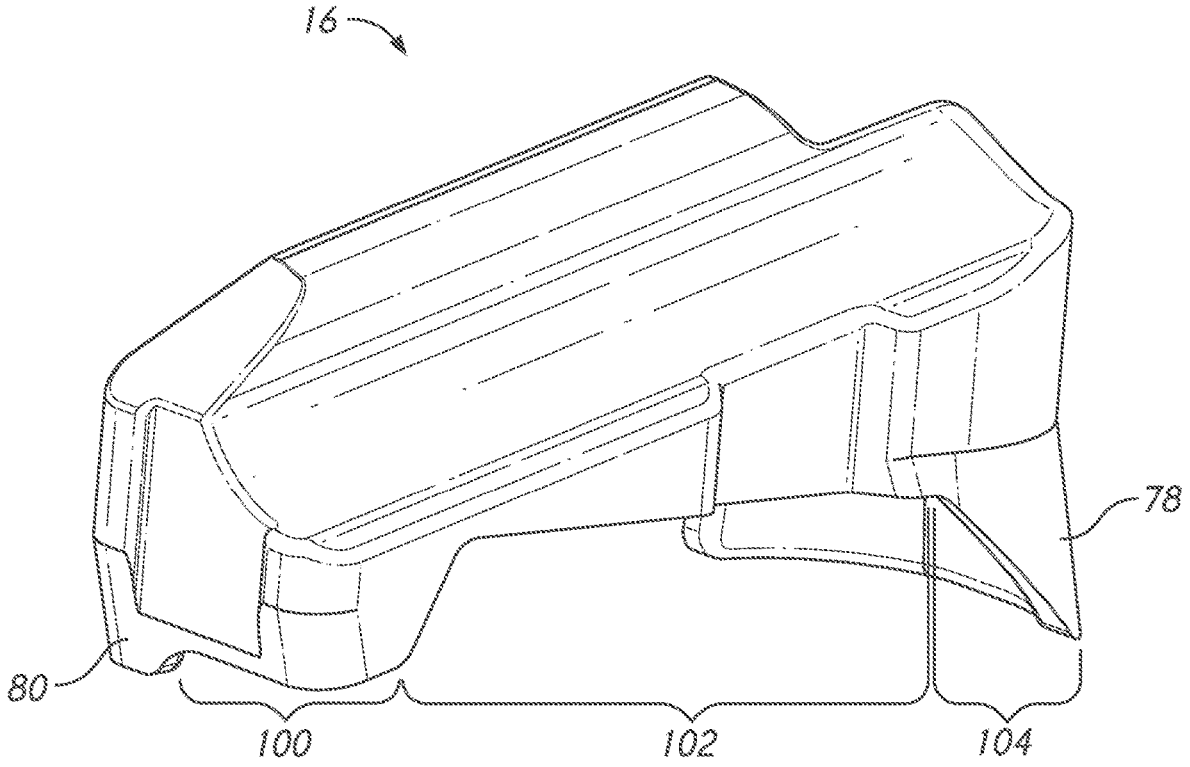
FIG. 14 is a perspective view, showing the right side of the follower.

The follower in the present invention preferably includes reliefs that allow the follower to move laterally with respect to the spring so that the follower can rest beside portions of the compressed spring. A follower can be configured to move to the left or the right. In the illustrated embodiments the follower moves to the left. FIG. 14 shows a view of the right rear side of follower 16. The follower shown is the same embodiment as depicted in the other figures.

Central lateral relief 102 extends through both sides of the follower (the opposite side is visible in FIG. 8). Forward skirt 78 lies forward of central lateral relief 102 and rearward skirt 80 lies to the rear of central lateral relief 102. The reader will note, however, that the right side of both skirts include additional reliefs. Rear corner relief 100 is provided on the right side of rearward skirt 80. Forward corner relief 104 is provided on the right front of forward skirt 78.

FIG. 9 shows the follower from underneath. The presence of rear corner relief 100 means that right rear leg 110 (the lowest portion of the right rear) is higher than left rear leg 112. Left front leg 108 provides a nearly constant elevation while right front leg 106 is relieved by the curved forward corner relief 104. The net result is that a portion of the spring can extend laterally out the right side of the follower and the follower can therefore translate to the left as the spring is compressed.

Figure 15:
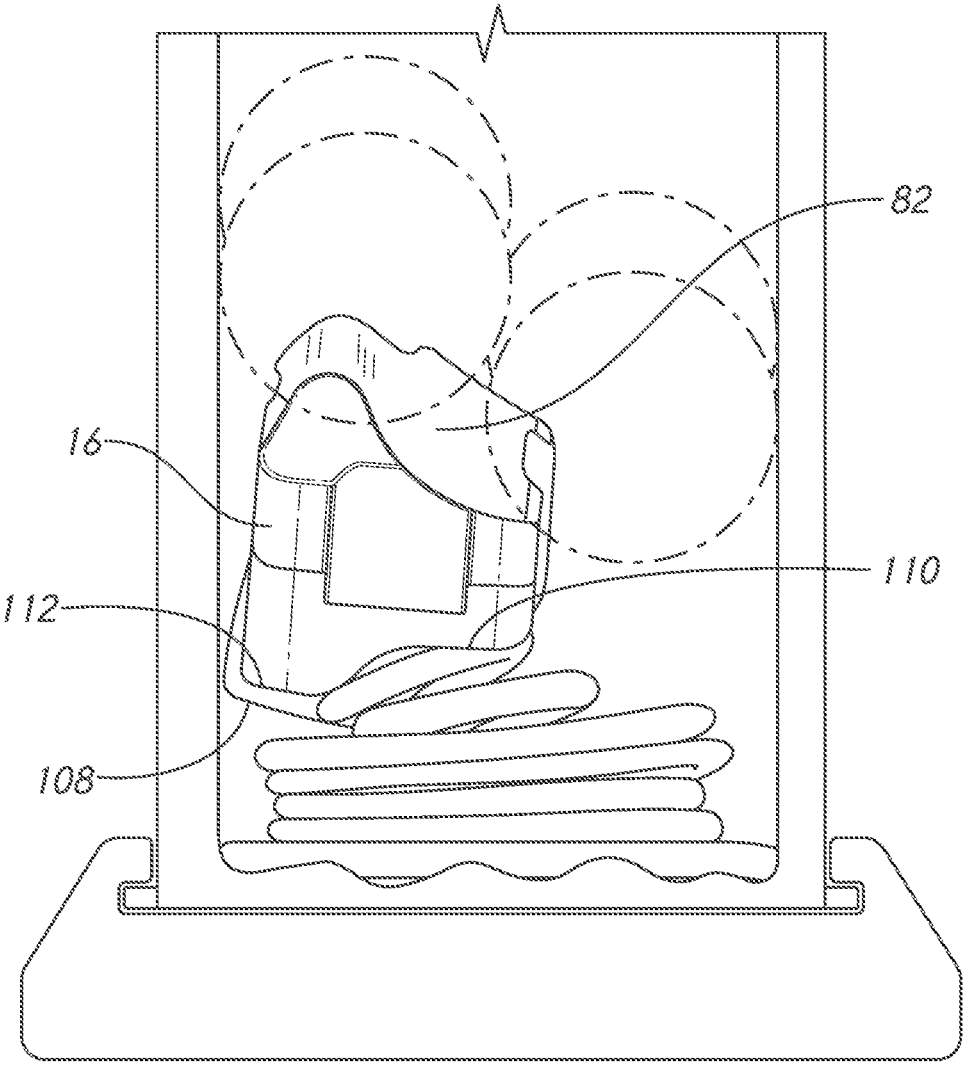
FIG. 15 is a rear elevation view, showing the interaction between the follower and the magazine spring when the spring is fully compressed.

FIG. 15 is provided to better illustrate the advantage of the features allowing the lateral movement of the follower with respect to the spring. FIG. 15 shows a detailed elevation view of follower 16 and spring 18 when the spring approaches the fully compressed state. The reader will note in FIG. 15 that follower 16 is actually canted upward in comparison to its orientation in FIG. 2. The upward cant can be easily seen via the fact that curved cradle 82 slopes upward (It rises when proceeding in a direction away from the viewer). The cartridges are shown only as phantom lines, but the reader will note that the cartridges proximate the bottom of the magazine are also canted upward.

The reason for this upward cant is found in the geometry of the cartridges themselves. The magazine depicted in the drawing views is configured to feed 9 mm Parabellum cartridges (also known as 9 mm Luger cartridges). As those skilled in the art will know, such cartridges have a tapered case. In such cartridges the rim diameter is typically 0.394 inches (10.01 mm). The case just forward of the rim has a diameter of 0.391 inches (9.931 mm). The diameter of the case neck is 0.380 inches (9.653 mm). When such cartridges are stacked in a magazine, they do not remain perfectly parallel. Instead, they naturally form a gradually curving arc because the rear portion of each cartridge is larger than the front portion.

The uppermost cartridge—the one about to be stripped from the magazine and loaded into the chamber—is preferably held parallel to the pistol's bore or possibly canted slightly upward. Each successively lower cartridge has an increased upward angle compared to the one just above. By the time the bottom of the magazine is reached, the upward cant is quite pronounced (as shown in FIG. 15). Left rear leg 112 is at or very near the same elevation as left front leg 108. Right rear leg 110 is higher because of the inclusion of rear corner relief 100 (see FIG. 14).

Still looking at FIG. 15, the reader will note how follower 16 has moved to the left with respect to spring 18. The inclusion of reliefs 100, 102, and 104 allows an upper portion of the spring to extend out the right side of the follower-thereby allowing the follower to move to the left and sit beside a portion of the compressed spring 18. This feature allows the follower to sit in a lower position when the spring is fully compressed.

Many other variations will of course occur to those skilled in the art. The invention is not limited to any particular embodiment. The variations can be combined as well. A non-exhaustive listing of such variations includes:

1. A coil nesting scheme in which four or more adjacent coils are nested.
2. A follower made of molded polymer.
3. A follower made of metal.
4. A magazine assembly with a metal tube.
5. A magazine assembly with a molded polymer tube.

Although the preceding descriptions contain significant detail, they should not be construed as limiting the scope of the invention but rather as providing illustrations of the preferred embodiments of the invention. Those skilled in the art will know that many other variations are possible without departing from the scope of the invention. Accordingly, the scope of the invention should properly be determined with respect to the following claims rather than the examples given.

Having described our invention, we claim:

1. A magazine for feeding a plurality of cartridges into a firearm, comprising:

(a) a tube having a lower end, an upper end, a forward wall, and a rearward wall, said tube including a double stack portion proximate said lower end and a transition portion proximate said upper end;
(b) a base closing said lower end of said tube;
(c) a follower within said tube, said follower being free to slide up and down in said tube;
(d) a magazine spring compressed between said base and said follower, including,
  (i) a straight portion including a first plurality of coils,
  (ii) said first plurality of coils including multiple sets of nesting coils, wherein a size of each coil within said first plurality differs from a size of adjacent coils so that each of said coils within said first plurality is able to nest with said adjacent coils when said magazine spring is compressed,
  (iii) a transition portion including a second plurality of coils,
  (iv) said second plurality of coils including a plurality of elongated coils having a length and a width, with said length of said elongated coils being greater than said width of said elongated coils;
(e) said follower having an upper portion and a lower portion, said upper portion being configured to bear against said cartridges loaded in said magazine and urge said cartridges upward;
(f) said lower portion of said follower opening into a spring receiver cavity sized to receive said second plurality of coils when said magazine spring is in a compressed state;
(g) said follower includes a forward skirt incorporating a forward guide surface;
(h) said follower includes a rearward skirt incorporating a rearward guide surface;
(i) said forward guide surface sliding along said forward wall of said tube;
(j) said rearward guide surface sliding along said rearward wall of said tube;
(k) said spring receiver cavity lying between said forward skirt and said rearward skirt;
(l) said spring receiver cavity includes a forward boss proximate said forward skirt;
(m) said spring receiver cavity includes a rearward boss proximate said rearward skirt; and
(n) an uppermost coil in said second plurality of coils encircles said forward boss and said rearward boss.

2. The magazine as recited in claim 1, wherein said spring receiver cavity contains three coils of said second plurality of coils when said magazine spring is in said compressed state.

3. The magazine as recited in claim 1, wherein:

(a) said magazine spring has a uniform wire diameter; and
(b) said first plurality of coils collapses to four of said wire diameters when said magazine spring is fully compressed.

4. The magazine as recited in claim 1, wherein:

(a) said first plurality of coils includes a first coil, a second coil, and a third coil;
(b) said second coil collapses inside said first coil; and
(c) said third coil collapses inside said second coil.

5. The magazine as recited in claim 4, wherein:

(a) said first plurality of coils includes a fourth coil and a fifth coil;
(b) said fourth coil collapses outside said third coil; and
(c) said fifth coil collapses inside said fourth coil.

6. A magazine for feeding a plurality of cartridges into a firearm, comprising:

(a) a tube having a lower end and an upper end, said tube including a double stack portion proximate said lower end and a transition portion proximate said upper end;
(b) a base attached to said lower end of said tube;
(c) a follower within said tube, said follower being free to slide up and down in said tube;
(d) a magazine spring compressed between said base and said follower, including,
  (i) a straight portion including a first plurality of coils,
  (ii) said first plurality of coils including multiple sets of nesting coils, wherein each coil within said first plurality nests with an adjacent coil when said magazine spring is compressed,
  (iii) a transition portion including a second plurality of coils,
  (iv) said second plurality of coils including a plurality of elongated coils having a length and a width, with said length of said elongated coils being greater than said width of said elongated coils;
(e) said follower having an upper portion and a lower portion, said upper portion being configured to bear against said cartridges loaded in said magazine and urge said cartridges upward;
(f) said lower portion of said follower opening into a spring receiver cavity sized to receive said second plurality of coils when said magazine spring is in a compressed state;
(g) said first plurality of coils having a first lateral side and a second lateral side;
(h) said second lateral side of at least some of said first plurality of coils having alternating cross overs that do not nest, causing said second lateral side to have a greater compressed height than said first lateral side; and
(i) said greater compressed height of said second lateral side of said first plurality of coils producing a lateral movement of said follower with said respect to said spring upon compression of said spring, causing said follower to sit beside a portion of said compressed spring.

7. The magazine as recited in claim 6, wherein:

(a) said follower includes a forward skirt incorporating a forward guide surface;
(b) said follower includes a rearward skirt incorporating a rearward guide surface;

(c) said forward guide surface sliding along a first interior surface of said tube;

(d) said rearward guide surface sliding along a second interior surface of said tube; and (e) said spring receiver cavity lying between said forward skirt and said rearward skirt.

8. The magazine as recited in claim 7, wherein:

(a) said spring receiver cavity includes a forward boss proximate said forward skirt;

(b) said spring receiver cavity includes a rearward boss proximate said rearward skirt; and (c) an uppermost coil in said second plurality of coils encircles said forward boss and said rearward boss.

9. The magazine as recited in claim 6, wherein said spring receiver cavity contains three coils of said second plurality of coils when said magazine spring is in said compressed state.

10. The magazine as recited in claim 6, wherein:

(a) said magazine spring has a uniform wire diameter; and (b) said first plurality of coils collapses to four of said wire diameters when said magazine spring is fully compressed.

11. The magazine as recited in claim 6, wherein:

(a) said first plurality of coils includes a first coil, a second coil, and a third coil;

(b) said second coil collapses inside said first coil; and (c) said third coil collapses inside said second coil.

12. The magazine as recited in claim 11, wherein:

(a) said first plurality of coils includes a fourth coil and a fifth coil;

(b) said fourth coil collapses outside said third coil; and (c) said fifth coil collapses inside said fourth coil.

13. A magazine for feeding a plurality of cartridges into a firearm, comprising:

(a) a tube having a hollow interior, with a double stack portion and a transition portion adjoining said double stack portion;

(b) a base attached to a lower end of said double stack portion;

(c) a follower slidably disposed within said hollow interior of said tube;

(d) a magazine spring located between said lower end of said double stack portion and said follower, including, (i) a straight portion including a first plurality of coils, (ii) said first plurality of coils including multiple sets of nesting coils, wherein each coil within said first plurality nests with an adjacent coil when said magazine spring is compressed, (iii) a transition portion including a second plurality of coils, (iv) said second plurality of coils including a plurality of elongated coils;

(e) said follower having an upper portion and a lower portion, said upper portion being configured to bear against said cartridges loaded in said magazine and urge said cartridges upward;

(f) said lower portion of said follower opening into a spring receiver cavity sized to receive said second plurality of coils when said magazine spring is in a compressed state;

(g) said first plurality of coils having a first lateral side and a second lateral side;

(h) said second lateral side of at least some of said first plurality of coils having alternating cross overs that do not nest, causing said second lateral side to have a greater compressed height than said first lateral side; and (i) said greater compressed height of said second lateral side of said first plurality of coils producing a lateral movement of said follower with said respect to said spring upon compression of said spring, causing said follower to sit beside a portion of said compressed spring.

14. The magazine as recited in claim 13, wherein:

(a) said follower includes a forward skirt incorporating a forward guide surface;

(b) said follower includes a rearward skirt incorporating a rearward guide surface;

(c) said forward guide surface sliding along said interior of said tube;

(d) said rearward guide surface sliding along said interior of said tube; and (e) said spring receiver cavity lying between said forward skirt and said rearward skirt.

15. The magazine as recited in claim 14, wherein:

(a) said spring receiver cavity includes a forward boss proximate said forward skirt;

(b) said spring receiver cavity includes a rearward boss proximate said rearward skirt; and (c) an uppermost coil in said second plurality of coils encircles said forward boss and said rearward boss.

16. The magazine as recited in claim 13, wherein said spring receiver cavity contains three coils of said second plurality of coils when said magazine spring is in said compressed state.

17. The magazine as recited in claim 13, wherein:

(a) said magazine spring has a uniform wire diameter; and (b) said first plurality of coils collapses to four of said wire diameters when said magazine spring is fully compressed.

18. The magazine as recited in claim 13, wherein:

(a) said first plurality of coils includes a first coil, a second coil, and a third coil;

(b) said second coil collapses inside said first coil; and (c) said third coil collapses inside said second coil.

* * * * *